United States Patent [19]

Takeuchi

[11] 4,095,673

[45] Jun. 20, 1978

[54] OIL CHANGER

[75] Inventor: Shigeo Takeuchi, Nagoya, Japan

[73] Assignee: Beauty Hanbai Kabushiki Kaisha, Nagoya, Japan

[21] Appl. No.: 698,205

[22] Filed: Jun. 21, 1976

[30] Foreign Application Priority Data

Jun. 19, 1975 Japan ..... 50-84492[U]

[51] Int. Cl.[2] ..... F01M 11/04

[52] U.S. Cl. ..... 184/1.5; 184/106

[58] Field of Search ..... 184/1 R, 1.5, 106; 141/323, 315

[56] References Cited

U.S. PATENT DOCUMENTS

| | | | |
|---|---|---|---|
| 1,655,939 | 1/1928 | Copeland | 184/1.5 X |
| 1,815,221 | 7/1931 | Sweetland | 184/1.5 |
| 2,020,350 | 11/1935 | Bertschinger | 184/1.5 |
| 2,320,048 | 5/1943 | Parson | 184/1.5 |
| 2,425,848 | 8/1947 | Vawter | 184/1.5 X |
| 2,612,289 | 9/1952 | Koester | 184/1.5 X |
| 2,755,969 | 7/1956 | Rainero | 184/1.5 |
| 3,033,311 | 5/1962 | Edgar et al. | 184/1.5 |
| 3,430,730 | 3/1969 | Kitajima | 184/1.5 |

*Primary Examiner*—David H. Brown

*Attorney, Agent, or Firm*—Haseltine, Lake & Waters

[57] ABSTRACT

A novel oil changer designed to enable one to visually determine the extent of contamination or deterioration of oil in service in comparison with fresh oil prior to change thereof for the purpose of attaining highly economical oil consumption. The oil changer includes an oil contamination inspection tank adapted to be selectively placed into communication with an external oil sump and a waste oil reservoir for forced passage therebetween of used oil under the drive of a pneumatically driven pump, and a metering tank for storing and metering fresh oil to be delivered therefrom to said external oil sump and adapted to be selectively placed into communication with a fresh oil reservoir and said metering tank for forced passage therebetween of fresh oil under the drive of a reversible pneumatically driven pump. The inspection tank is provided with wipers for cleaning its interior surface from the outside thereof, whereas the inspection tank is provided with a graduated overflow pipe for metering the amount of fresh oil to be delivered therefrom, the pipe extending in a vertical direction with its upper end opened into the tank interior at an appropriate level and its lower end connected with said fresh oil reservoir. With the above arrangement of the oil changer, oil change can be continuously effected in a very speedy and safe manner so as to substantially reduce the service time required therefor.

8 Claims, 2 Drawing Figures

OIL CHANGER

BACKGROUND OF THE INVENTION

This invention relates to an oil changer which is capable of extracting or drawing oil from an external oil reservoir such as, for example, an oil sump for engine oil on an automobile to compare the oil drawn with fresh oil for visually inspecting the contamination degree of the oil and if oil change is necessary, of immediately changing such contaminated oil with fresh oil, thus performing, by the use of a single oil changer, the three functions of extraction, contamination inspection and exchange of oil.

Conventionally, oil such as automobile engine oil, for example, when used for a certain time, is usually changed with fresh oil without inspecting the contamination or deterioration degree of such oil. For this reason, oil once used has often been discarded even where it is still usable for normal service, resulting in unnecessary or exccessive oil consumption. Further, because of absence of any convenient and effective measure for inspection of oil contamination, oil changing operations have heretofore been very troublesome and ineffective.

SUMMARY OF THE INVENTION

Accordingly, the primary object of the present invention is to provide a novel oil changer of the character described above which is capable of avoiding the inconveniences as referred to above, and which performs the three functions of extraction, contamination inspection and exchange of oil in a successive fashion, thus assuring the very speedy, efficient, and simple oil changing operation.

Another object of the present invention is to provide a novel oil changer of the character described which may be safely disposed in a service station even in the vicinity of a gasoline metering device where inflammable gases often generate, and which is operated in safety for oil changing purposes without incurring any dangerous situation even during refueling of gasoline or other volatile fuels.

A further object of the present invention is to provide a novel oil changer of the character described in which a transparent tank, into which oil to be checked is drawn and of which interior surface is frequently smeared with dirts or contaminants in the drawn oil, is readily cleaned interiorly by means of wipers so that the oil in the tank can be seen clearly from the outside for visual inspection of contamination or deterioration thereof.

A still further object of the present invention is to provide a novel oil changer of the character described in which even in the event a transparent tank provided to store and meter fresh oil is inclined or fresh oil therein is disturbed to surge, it is always possible to meter the volume of fresh oil to be distributed therefrom for replacement of contamination oil with a maximized accuracy.

A further object of the present invention is to provide a novel oil changer of the character described which is simple in construction and in which the tank for fresh oil can be fed with a predetermined exact volume of fresh oil without necessitating any special attention of the operator, thereby enabling him to do another job during such oil feeding operation.

The above and other objects, features and advantages of the invention will be more fully understood from the following detailed description, when taken in conjunction with the accompanying drawing, which illustrates a preferred exemplary embodiment of the invention.

DESCRIPTION OF PREFERRED EMBODIMENT

Figure 1:
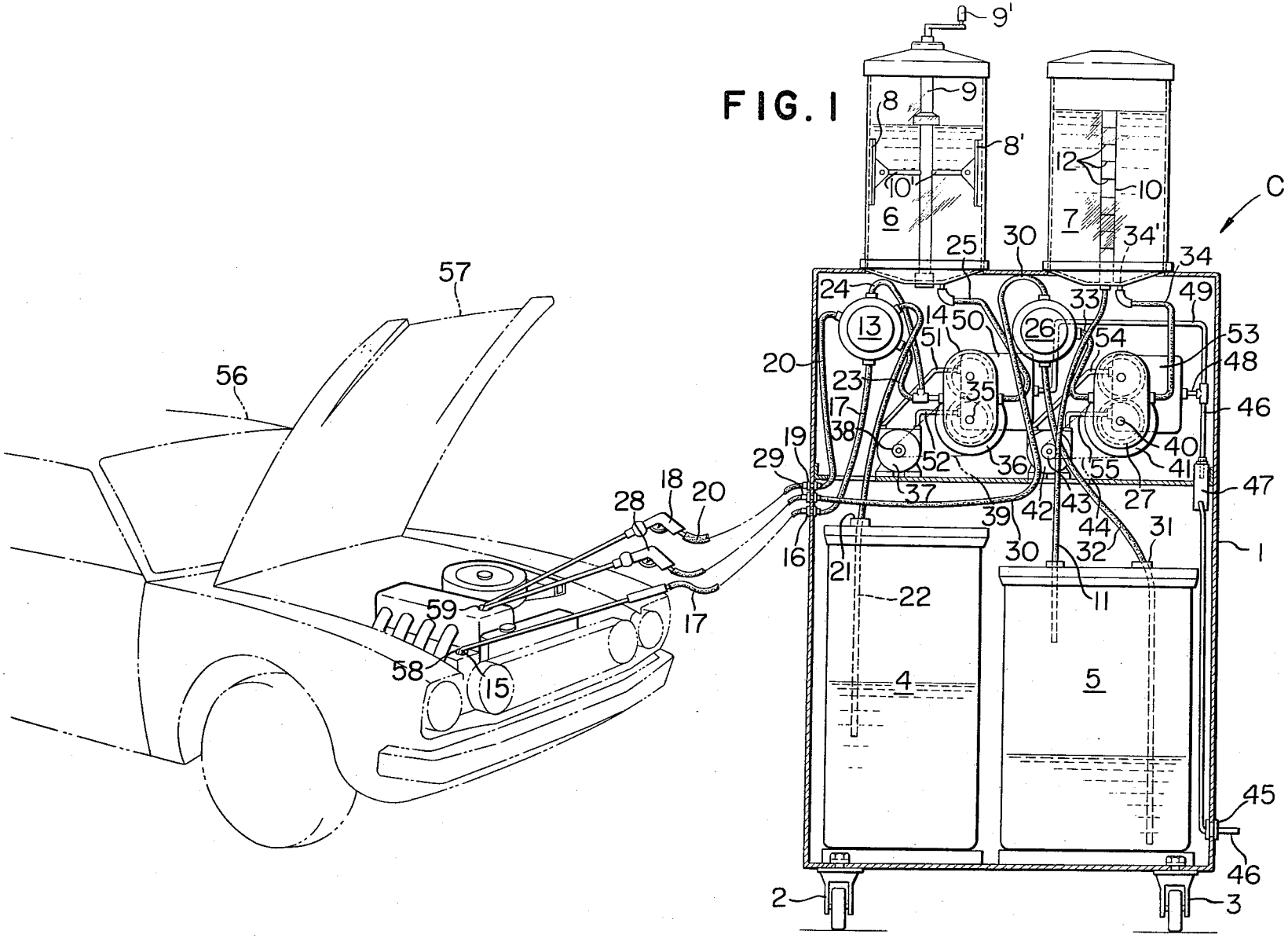
FIG. 1 is a front elevational view, partially in vertical section, of an oil changer embodying the present invention, showing the oil changer effecting oil change with respect to an associated automobile.

Referring to the drawings and first to FIG. 1 there is shown an oil changer, generally designated at C and constructed according to the principles of the present invention, a frame structure 1 of which is provided at the bottom thereof with casters 2, 3 for free movement on a floor or ground. Disposed within the frame structure 1 on the bottom thereof are a pair of reservoirs 4, 5 one for waste oil and the other for fresh oil. On the top of the frame structure, there are disposed an oil contamination inspection tank 6 for used oil and a metering tank 7 for fresh oil adjacent thereto, each of these tanks having a cylindrical side wall formed of transparent material such as glass so as to enable one to observe therethrough the tank interior for visual inspection of oil therein.

Within the inspection tank 6 there is arranged a vertical rotation shaft 9 which extends vertically in alignment with the longitudinal axis of the cylindrical tank 6 with its opposite ends rotatably supported in the top and bottom portions of the tank 6. The shaft 9 carries thereon a pair of support arms 10', 10' extending radially outwardly from the longitudinally middle portion thereof with their radially outer ends havind wipers or cleaning brushes 8, 8' respectively attached thereto. A rotation handle 9' is fixedly secured to the upper end of the vertical rotation shaft 9 so that by rotating the handle 9', the wipers 8, 8' carried by the shaft 9 is caused to rotate around the axis of the shaft in sliding contact with the interior surface of the transparent tank 6, whereby the tank surface, which may be smeared with dirts or contaminants in used oil to be checked, is cleaned effectively.

Inserted into the cylindrical metering tank 7 through the central portion of the bottom thereof is a hollow transparent overflow pipe 10, which extends vertically in coaxial relation with the longitudinal axis of the tank 7 with its upper end opened into the interior of the metering tank 7 at an appropriate height from the bottom thereof and its lower end connected with an oil return tube 11 leading to the fresh oil reservoir 5.

The overflow pipe 10 is provided on its outer surface with scale marks 12 encircling its full circumference so that as detaild later, fresh oil in the metering tank 7 previously fed thereto from the fresh oil reservoir 5 can be delivered therefrom at respective quantities as required.

Disposed within the frame structure 1 between the waste oil reservoir 4 and the inspection tank 6 are a three-way cock or valve 13 and a gear pump 14. The three-way valve 13 is connected through respective ports with a flexible tube 17 extending outwardly therefrom through the frame structure 1 at 16 with its exterior end coupled to a slender oil-drawing pipe 15, with a flexible tube 20 extending outwardly therefrom through the frame structure 1 at 19 with is exterior end coupled to a pistol-shaped valve 18 having a slender elongated portion, and with a flexible tube 22 leading to the interior of the waste oil reservoir 4 through an opening 21 formed in the top thereof. The three-way valve 13 is further connected through separate ports with a pair of flexible conduits 23, 24 which are joined together into a single conduit connected with an inlet port of the gear pump 14, which is in turn connected at its outlet port with a flexible conduit 25 leading to the interior of the inspection tank 6.

Also disposed within the frame structure 1 between the fresh oil reservoir 5 and the metering tank 7 are a two-way cock or valve 26 and a gear pump 27. The two-way valve 26 is connected through respective ports with a flexible tube 30 extending outwardly therefrom through the frame structure 1 at 29 with its exterior end coupled to a pistol-shaped valve 28 having a slender elongated portion, with a flexible tube 32 leading to the interior of the fresh oil reservoir 5 through an opening 31 formed in the top thereof, and with a flexible tube 33 leading to an inlet port of the gear pump 27, which is in turn connected at its outlet port with a flexible tube 34 leading to the interior of the metering tank 7.

The gear pump 14 is provided with a gear shaft 35 fixedly carrying thereon a driven pulley 36 drivably coupled to a drive pulley 38 of an air motor 37 by means of a belt 39. Similarly, the gear pump 27 is provided with a gear shaft 40 fixedly carrying thereon a driven pulley 41 drivably coupled to a drive pulley 43 of an air motor 42 by means of a belt 44.

It should be readily understood to those skilled in the art that in the illustrated embodiment two individual air motors are employed for driving the two gear pumps, but if preferred, one single air motor in combination with appropriate transmission means will be satisfactory for this purpose.

An air pipe 46 is extending through the lower portion of the side wall of the frame structure 1 as at 45 to be connected at one end with an external source of pressure air (not shown) and at the other end has a pair of branch conduits 48, 49 bifurcated therefrom with an air filter 47 interposed between the bifurcation and the source of air pressure, one of the conduits, 48 being in connection with a box-shaped changeover cock or valve 53 which is in turn connected with the air motor 42 by way of a pair of air pipes 54, 55 so that by operating the changeover valve 53, the air motor 42 is caused to selectively rotate under air pressure in the forward or reverse direction, whereas the other conduit 49 is in connection with a box-shaped changeover cock or valve 50 which is in turn connected with an air motor 37 by way of a pair of air pipes 51, 52 so that by operating the changeover valve 50, the air motor 37 is caused to selectively rotate under air pressure in the forward or reverse direction.

In the figure in the left-hand side thereof, there is illustrated an automobile 56 as an example of requiring oil change, which is provided under a bonnet 57 with an oil inspection hole 58 and an oil filler opening 59 formed on the top of the engine.

In describing operation of the present oil changer, let us consider the case in which engine oil used in the automobile illustrated is checked in terms of contamination and then replaced with new oil by the use of this oil changer.

To this end, the frame structure 1 of the oil changer C is first moved to a preparatory position as shown in the Figure. Initially, the two-way valve 26 is operated to place the flexible tubes 32, 33 into communication with each other and the changeover valve 53 is then operated to cause the gear pump 27 to rotate in the forward direction so that fresh oil stored in the fresh oil reservoir 5 is fed to the metering tank 7 through the flexible tube 32, two-way valve 26, flexible tube 33, gear pump 27, flexible tube 34 and inlet port 34', to reach a definite level corresponding to the height of the overflow pipe 10.

In this connection, it should be noted that oil fed to the metering tank 7 in excess of the height of the overflow pipe 10 is returned through the hollow pipe 10 and the return tube 11 to the fresh oil reservoir 8 so that the metering tank 7 is at any time filled with a definite volume of fresh oil without requiring any operator's special attention, thus enabling him to do another job during such oil filling operation. Further, the scale marks 12 provided on the metering pipe 10 to encircle the full circumference thereof permit one to visually read the scale marks from any direction therearound. In addition, the metering pipe 10 is positioned centrally of the fresh oil metering tank 7 to extend vertically in coaxial relation with the cylindrical tank 7 so that even where the frame structure 1 stands on an inclined surface or ground and hence the tank 7 is tilted or even where oil in the tank 5 is disturbed to surge, it is always possible to effect accurate metering of the quantity of oil to be delivered therefrom.

In inspecting the degree of contamination of engine oil, the slender oil drawing pipe 15 is inserted into the inspection hole 58 and the three-way valve 13 is operated to establish communication between the flexible tubes 17 and 23. Subsequently, the changeover valve 50 is operated to cause the gear pump 14 to rotate in the forward direction so that oil in the automobile 56 is drawn into the inspection tank 6 via oil drawing pipe 15, flexible tube 17, three-way valve 13, flexible tube 24, gear pump 14 and flexible tube 25, and once the oil drawn in the tank 6 reaches to an appropriate level, the gear pump 14 is caused to stop rotation. On this occasion, the handle 9' may, if necessary, be operated to rotate the wipers 8, 8' to clean the interior surface of the tank 6 for improved visibility. Then, drawn oil in the tank 6 is visually compared with fresh oil in the metering tank 7 to determine the extent of contamination or deterioration thereof. In this case, inspection should also be made in terms of color or tint and dust mixture of the used oil in comparison with the fresh oil.

As a result of the above inspection, if it is found that the degree of oil contamination or deterioration is low and in the range of allowable limits, in other words oil inspected is still suitable for normal use, the three-way valve 13 is operated to establish communication between the flexible tubes 20, 24 and the changeover valve 50 is switched over to reverse the rotation of the gear pump 14. Then, the slender tip portion of the pistol-shaped valve 18 is inserted into the oil filler opening 59 and the valve 18 is opened to return the oil in the inspection tank 6 to an oil sump (not shown) of the automobile.

On the other hand, however, if it is found that the degree of oil contamination or deterioration is high and oil change is required, then the two-way valve 26 is switched over so as to establish communication between the flexible tubes 30, 33 and the changeover valve 53 is operated to reverse the rotation of the gear pump 27. Thereafter, the pistol-shaped valve 28 with its tip portion inserted into the oil filler opening 59 is triggered to open so that the fresh oil in the metering tank 7 is supplied through the oil filler opening 59 to the oil sump of the automobile 56 at a desired quantity while careful attention being paid to the reading of scale marks 12 on the metering pipe 10.

To discharge from the inspection tank 6 the oil contaminated or deteriorated to such a degree as unsuitable for use, the three-way valve 13 is shifted to establish communication between the flexible tubes 22 and 24 and the changeover valve 50 is operated to reverse the rotation of the gear pump 14, whereby the contaminated or deteriorated oil in the tank 6 is discharged into the waste oil reservoir 4 by way of flexible tube 25, gear pump 14, flexible tube 24, three-way valve 13, and flexible tube 22.

Figure 2:
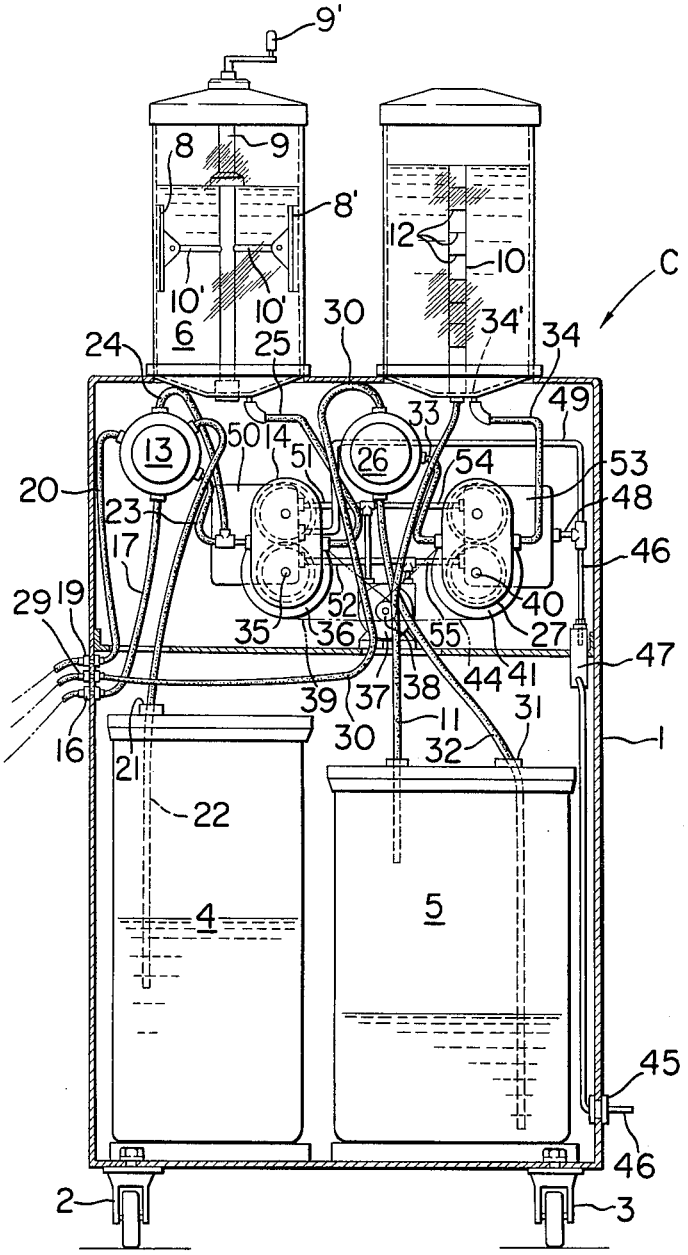
FIG. 2 is a view similar to FIG. 1, showing a modification of the oil changer.

FIG. 2 shows a modified form of oil changer in which the first and second pumps 14 and 27 are simply driven by means of a single air motor 37, and in other respects, this embodiment is similar in construction and operation to the aforementioned first embodiments, with the equivalent components being indicated by the same references as those in the first embodiment. Accordingly further description of this embodiment has been omitted.

From the foregoing description, it will be appreciated that the present oil changer involves the following various advantages.

In accordance with one aspect of the present invention, by provisions of the inspection tank 6 and the metering tank 7, oil used in a hydraulic system such as an engine lubricating system or a hydraulic servo-motor can be visually compared with fresh oil for inspecting the degree of contamination or deterioration thereof prior to being put into the discard. For this reason, it is avoided to discard the used oil unnecessarily, which is still usable, and to consume fresh oil uneconomically, thereby contributing to oil saving and most efficient use thereof.

In accordance with another aspect of the present invention, by the use of a single oil changer unit, the three functions of drawing, inspecting and replacing of oil are all performed successively in a very simple way and in a relatively short time, thereby greatly inhancing the efficiency in the whole oil changing operation.

In accordance with a further aspect of the present invention, the overflow or metering pipe 10 graduated with the scale marks 12 is located centrally of the transparent metering tank 7 and extends in a vertical direction with its lower end connected to the fresh oil reservoir 5 through the return conduit 11 and its upper end opened into the interior of the tank 7 at an appropriate height above the bottom thereof. Due to the above arrangement, even where the metering tank 7 is caused to incline or even where the oil contained in the tank 7 is disturbed to surge, it is always possible for one to meter the quantity of fresh oil to be delivered from the tank 7 with a maximized accuracy simply by reading the scale marks 12 on the metering pipe 10, and in addition, in feeding the metering tank 7 with fresh oil, there is no need for one doing such job to pay any special attention thereto, whereby enabling him to do another job at the same time.

In accordance with a still further aspect of the present invention, the oil changer doing the aforementioned three functions is driven by means of the air motors 37, 42 alone (if desired, only a single air motor) without using any electric motors or electric control devices which often involve the danger of causing electric sparkings. This ensures extremely safe operation of the changer even in the vicinity of gasoline metering devices in a gasoline stand where inflammable gases often generate. Moreover, during the time when fuel such as gasoline is refilled, oil change may be effected simultaneously, thereby shortening the customers' waiting time therefor to a considerable extent.

In accordance with another aspect of the present invention, since drawing, returning and feeding of oil with respect to an external oil reservoir such as an oil pan of an automobile can be effected forcibly under the drive of the air motors 37, 42, heavy oil of high viscousity can be effectively changed with no difficulty.

In accordance with a further aspect of the present invention, by simply rotating the handle 11 affixed to the vertical rotation shaft 9, the wipers 8, 8' carried thereon are rotated in sliding contact with the interior surface of the cylindrical transparent tank 6, which may be smeared with dirty or contaminated oil drawn therein, to remove clearly dirts or contaminants adhering thereto so that the interior surface of the tank 6 can be cleaned readily from the outside to obtain good transparency for improved visual inspection through the tank wall of the oil therein.

While only one preferred exemplary embodiment of the present invention has been shown and described, it will be apparent to those skilled in the art that various changes and modifications may be made without departing from the sprit of the invention or from the scope of the appended claims.

What is claimed is:

1. An oil changer comprising a first transparent tank for inspecting the contamination degree of used oil drawn therein, a first reservoir for waste oil, a first pneumatically driven pump having an outlet port connected with said first tank and an inlet port connected with a three-way valve leading to said first reservoir and an external oil sump, said three-way valve being adapted to selectively place said first tank into communication with said first reservoir or with said external oil sump, a second transparent tank for storing and metering fresh oil, a second reservoir for fresh oil, and a second pneumatically driven pump having an outlet port connected with said second tank and an inlet port connected with a two-way valve leading to said second reservoir and said external oil sump, said two-way valve being adapted to selectively place said second tank into communication with said second reservoir or with said external oil sump.

2. An oil changer as claimed in claim 1, wherein the first and second pnuematically driven pumps are driven by means of two separate air motors, respectively.

3. An oil changer as claimed in claim 1, wherein the first and second pumps are driven by means of a single air motor in common therewith.

4. An oil changer as claimed in claim 1, wherein said first tank has a cylindrical shape.

5. An oil changer as claimed in claim 4, wherein a support shaft is disposed within said first tank to extend coaxially and longitudinally along the longitudinal axis of said first tank, said support shaft carrying thereon at least one support arm extending radially outwardly therefrom, said support arm having a wiper attached to its radially outer end in sliding contact with the interior surface of said first tank.

6. An oil changer as claimed in claim 1, wherein a hollow pipe is inserted into the interior of the second tank from the central portion of the bottom thereof to extend in a vertical direction, the pipe having its upper end opened into the interior of the second tank at an appropriate height above the bottom thereof and its lower end connected with the second reservoir.

7. An oil changer as claimed in claim 6, wherein the hollow pipe is graduated along its length with scale marks for metering the volume of fresh oil to be distributed from the second tank.

8. An oil changer as claimed in claim 7, wherein the scale marks encircle the outer periphery of the hollow pipe in parallel relation to each other at a equal longitudinal spacing between mutually adjacent ones thereof.

* * * * *